United States Patent [19]

Laauwe

[11] Patent Number: 4,823,994

[45] Date of Patent: Apr. 25, 1989

[54] SPECIALITY CLOSURES FOR BOTTLE NECKS

[76] Inventor: Robert H. Laauwe, 237 Green Ridge Rd., Franklin Lakes, N.J. 07417

[21] Appl. No.: 18,706

[22] Filed: Feb. 25, 1987

[51] Int. Cl.[4] ..... B22D 37/00

[52] U.S. Cl. ..... 222/521; 222/549

[58] Field of Search ..... 222/521, 520, 519, 548, 222/549, 153, 542, 562, 525, 522

[56] References Cited

U.S. PATENT DOCUMENTS

| | | | |
|---|---|---|---|
| 2,591,231 | 4/1952 | Boadway | 222/521 |
| 3,216,630 | 11/1965 | Stall | 222/521 |
| 3,406,880 | 10/1968 | Stall | 222/521 |
| 4,474,314 | 10/1984 | Roggenburg, Jr. | 222/521 |

*Primary Examiner*—Joseph J. Rolla
*Assistant Examiner*—Kenneth Noland
*Attorney, Agent, or Firm*—Kenyon & Kenyon

[57] ABSTRACT

A closure for a bottle neck having a tubular upper portion internally having an upstanding post having at least one axially extending passage. The base has an upstanding portion having an external screw thread. The cap has a skirt rotatively surrounding the upper portion, and the skirt has at least one internal protuberance in screw threaded engagement with that screw thread. The cap has a closed top in which a hole is formed and which is closed by the upper end of the post formed by the base, the hole being closed by this upper end when the cap is screwed downwardly and opened when the cap is screwed upwardly.

1 Claim, 4 Drawing Sheets

Fig. 1.
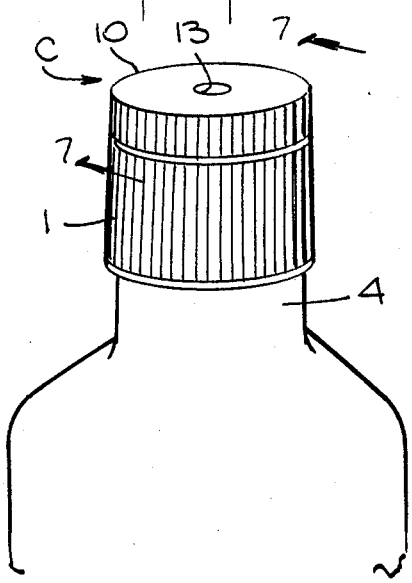
Fig. 2.
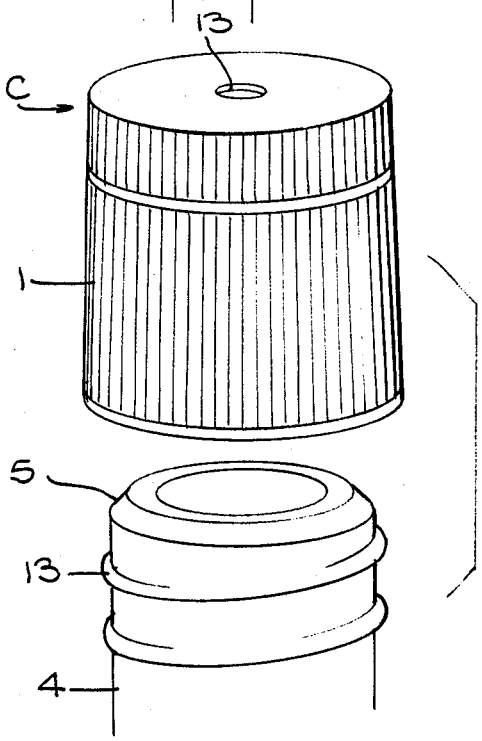
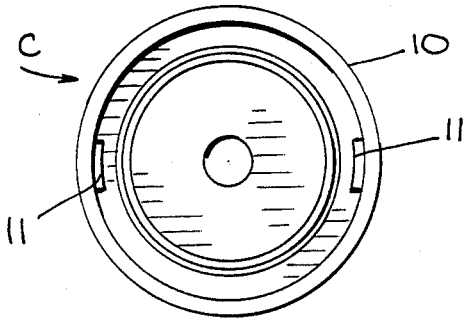
Fig. 4.
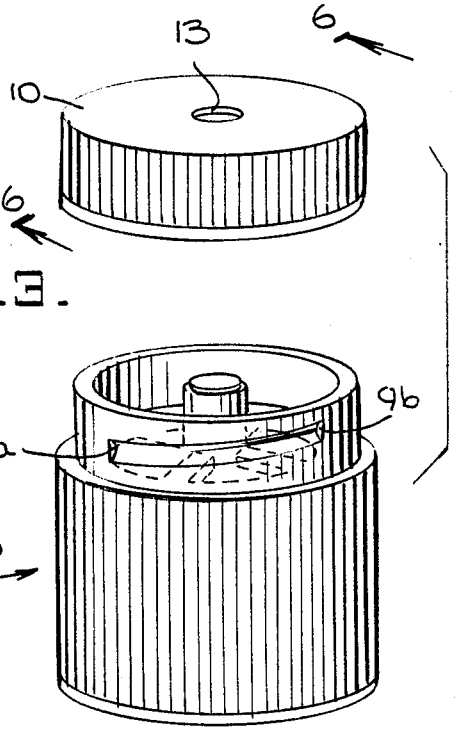
Fig. 3.
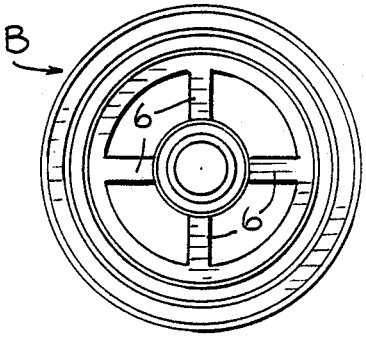
Fig. 5.

SPECIALITY CLOSURES FOR BOTTLE NECKS

This invention relates to speciality closures for bottles, usually squeeze bottles.

Speciality closures conventionally comprise a base which is threaded to fit a standard bottle neck thread. A cap is connected to the base rotatively, and by turning the cap, the closure can be opened and closed. Speciality closures are usually made from injection molded plastic parts.

There are many prior art designs, but they have had the disadvantage of being relatively complicated and requiring the use of loose sealing elements, all of which makes assembly of the valves undesireably complicated.

As a brief summary of the present invention, it is a new speciality closure formed of only two injection molded components. One is a base having a lower part that is internally threaded for screwing on the bottle neck, and having a tubular upstanding extension internally forming an upstanding post mounted on a radial support fixed to the inside of the tubular extension. This support has at least one axial passage and is preferably formed by radial spokes. This upstanding tubular extension is externally screw threaded.

The second component is a cap having a skirt rotatively surrounding the tubular extension of the first component. The skirt has at least one internal protuberance in screw threaded engagement with the previously mentioned external screw thread of the first component. For easy assembly of the closure, the skirt of the second component is made thin enough to have radial elasticity so that when the two components are pushed together, the protuberance of the second component snaps in engagement with the screw thread.

The cap has a closed top, in which a hole is formed in axial registration with the upper end or top of the previously mentioned post, and which is closed by this upper end when the cap is screwed downwardly and opened with the cap is screwed upwardly.

The base and cap are formed with integral seals. Separate seals are not used.

A specific example of this new closure is illustrated by the accompanying drawings, in which:

FIG. 1 is a perspective view of the new cap applied to a bottle neck;

FIG. 2 is a perspective view of the cap on an enlarged scale;

FIG. 3 is like FIG. 2, but shows the cap before its application to the base and a thread with which the cap is in screw threaded engagement when the speciality closure is put together;

FIG. 4 is a bottom view of the cap;

FIG. 5 is a top view of the base;

Figure 6:
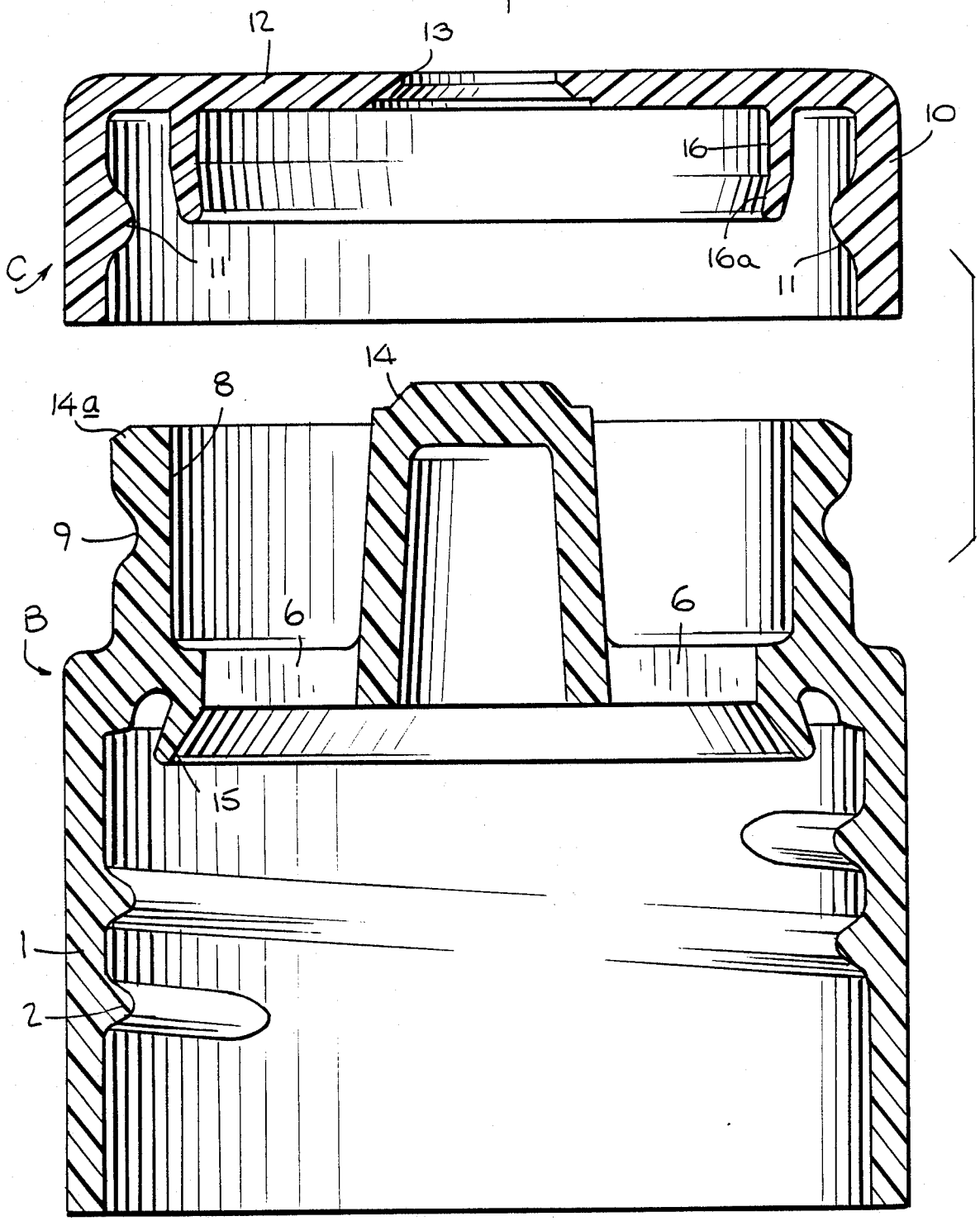
FIG. 6 is longitudinal section and at a much enlarged scale, shows the components of the new valve with the cap about to be applied to the base.
Figure 7:
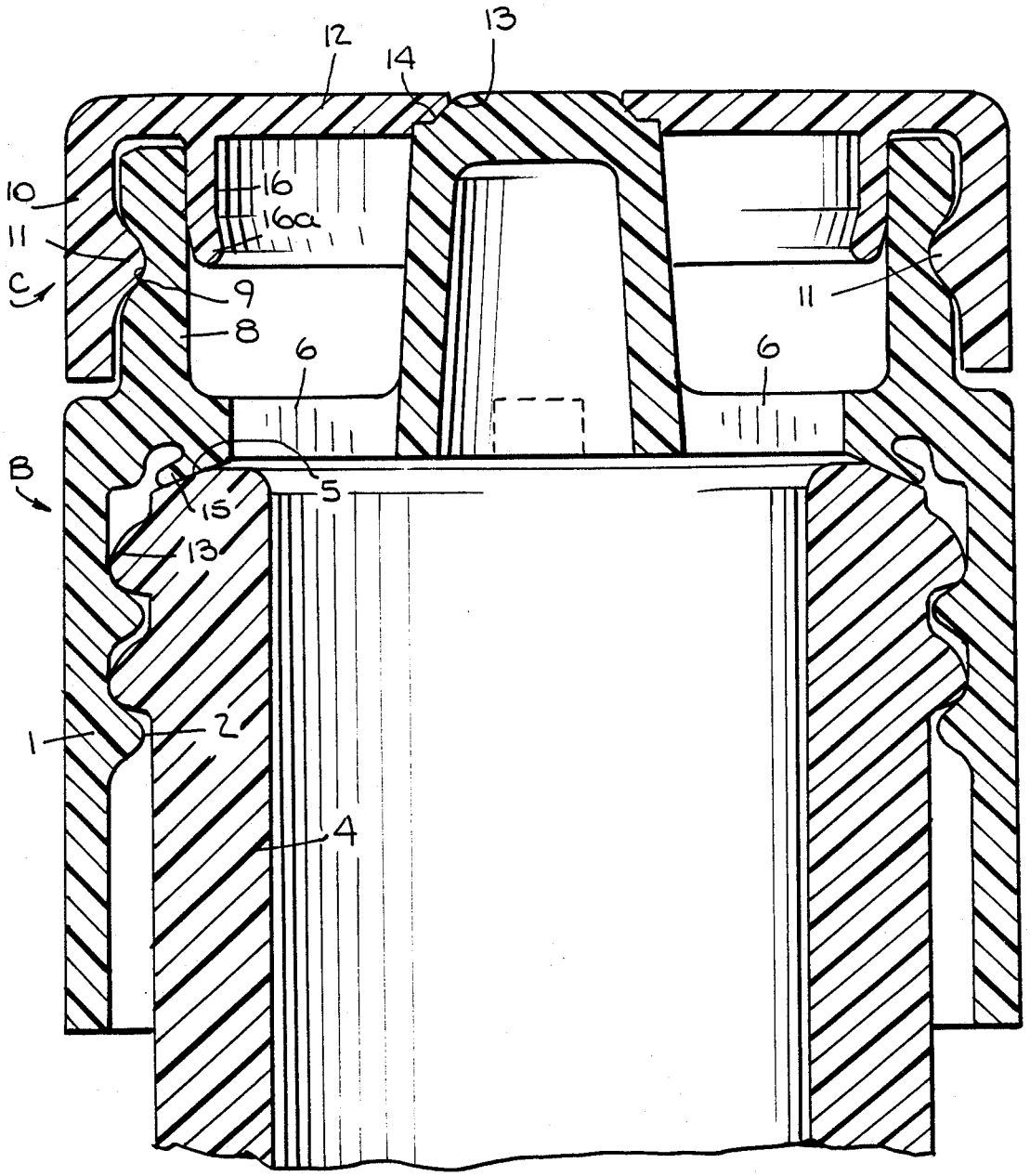
FIG. 7 is like FIG. 6, but shows the cap applied to the base and in a closed position.
Figure 8:
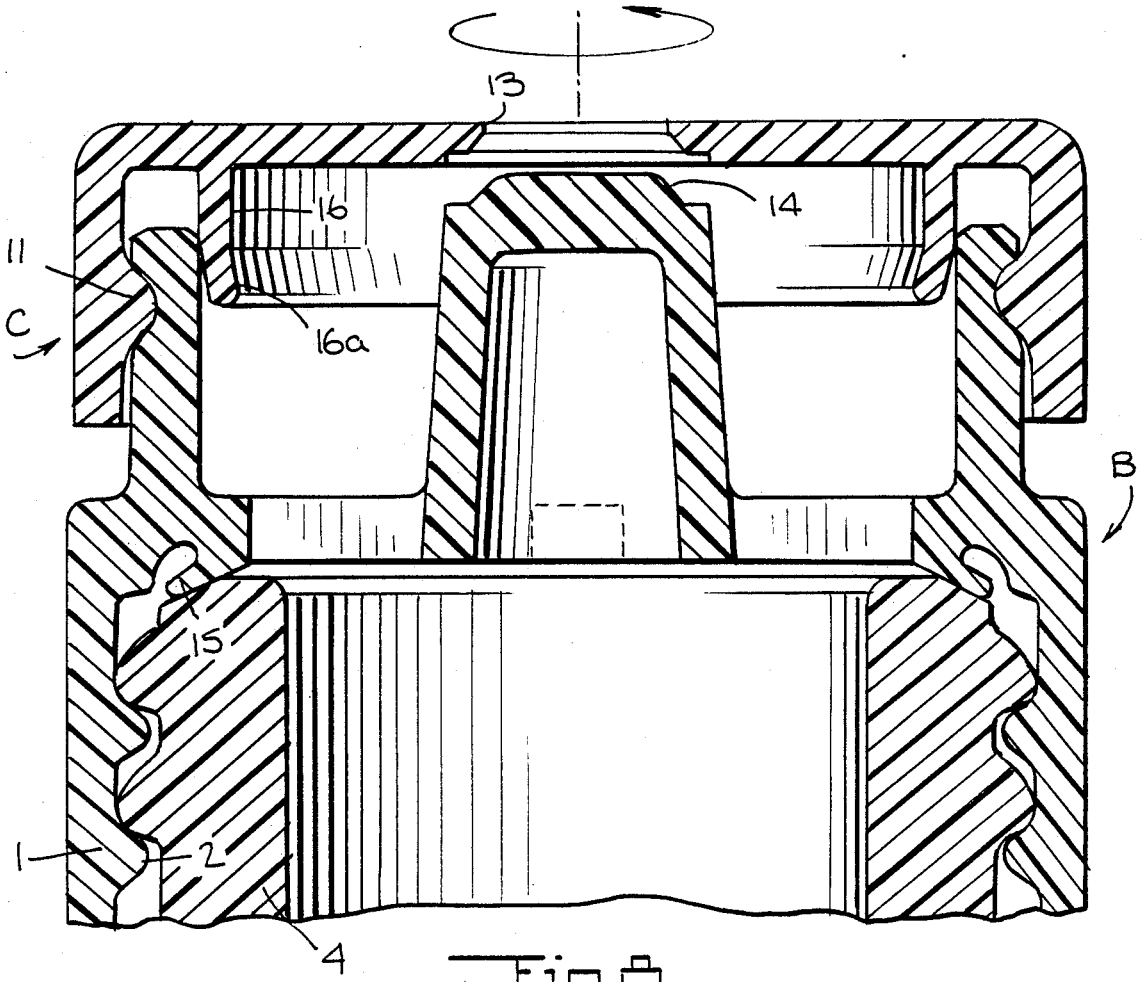
FIG. 8 is like FIG. 7, but shows the cap rotated to the open position.
Figure 9:
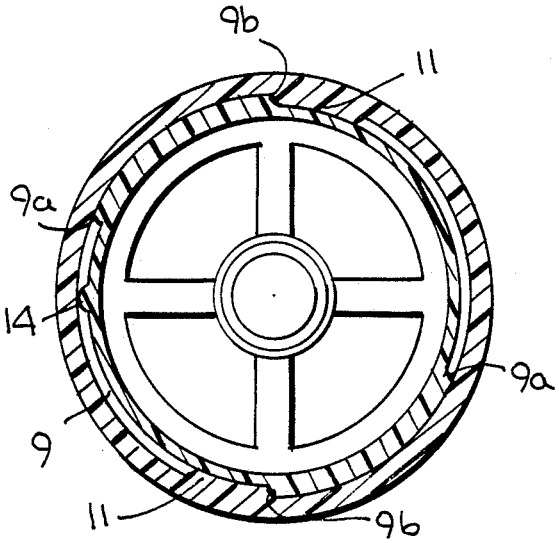
Figure 10:
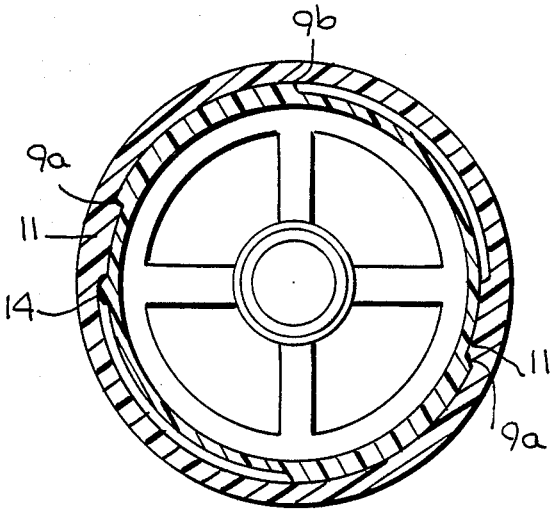

FIG. 9 in cross-section shows how the rotation of the cap can be limited, the cap appearing in one extreme of its rotative movement; and FIG. 10 is the same as FIG. 9, but shows the cap rotated to the opposite extreme of its rotative movement.

As shown by the above drawings, the new closure comprises a base B having a lower portion or skirt 1 with internal screw threads 2 designed to be screwed on the standard threads 3 of a squeeze bottle neck 4 having the usual smooth surfaced annular top 5.

The upper portion of the base B has inwardly extending radial spokes 6 centrally supporting an upstanding post 7, shown in the form of an inverted cup. The base adjacent its outer periphery has an upstanding tubular extension 8 having external screw threads 9, each extending only partly around the extension 8.

All parts of the base can be a single integral part made of plastic and formed by conventional injection molding techniques.

The cap C has a skirt 10 provided with diametrically opposite integral protuberances 11 respectively engaging the screw threads 9 of the base's tubular extension 8. The cap has a closed top 12 in which a hole 13 is formed in axial registration with the upper end or top of the post 7 of the base. This hole is closed by this upper end or top of the post when the cap is screwed downwardly by rotating it relative to the base, and is opened when the cap is screwed upwardly.

The closed top 12 is relatively rigid and can not flex appreciably. Its surface bounding the hole 13, and top of the post 7, form cooperating inter-mating surface's 14 which mate together when the cap C is screwed downwardly. Complete unscrewing of the cap is prevented by the threads 9 each having terminal ends 9A and 9B against which the protuberances 11 abut so that the rotation of the cap C relative to the base B is limited. One of these screw threads 11 is provided for each of the projections 11. The projections 11 are smoothly rounded transversely and the top of the upstanding tubular extension 8 is beveled around its outer edge to form a cam surface **14*a*. This permits easy assembly of the two parts of the closure. The cap C is simply pressed downwardly on the base B and the cap's skirt 10 is elastically flexed outwardly and then so the projections can snap into the screw threads 9**. The cap remains rotative relative to the base.

The annular surface 5 of the standard squeeze bottle mouth is smooth and declines radially outwardly with a small angularity. The base B is formed with an annular outwardly declining lip 15 that elastically presses against the surface 5 when the base is screwed downwardly on the bottle mouth. In this connection it is to be understood that both the base and cap are respectively integral plastic moldings, but although the plastic is semi-rigid, any parts of thin cross-sectioning permits elastic flexture.

To seal the cap relative to the base, its closed top 12 has an annular depending seal 16 which elastically seals against the inner surface of the upstanding tubular extension 8 of the base. This seal 16 is elastically displaced radially inwardly when the cap is pushed on the base, the seal 16 having a lower edge 16A which angles inwardly to provide a cam action working against the inside of the tubular extension 8 of the base. This seal 16 is in the form of a depending elastic skirt.

The two parts of the new closure are uncomplicated in design and each can be injection molded from plastic such as is normally used for the prior art bottle top closures. As previously mentioned, assembly of the two parts is easily effected because they snap together.

In its open position, the bottle content flows upwardly between the spokes 6 of the base, and through the hole 13 in the cap's closed top 12. The inter-mating conical surfaces 14 of the post and closed top 12, easily permit a viscous fluid to be squeezed clear of this surface to provide for positive sealing when the closure is turned to its closed position. The top of the cap is, of course, closed throughout its radial extent.

This new closure is symmetrical about its vertical axis. The closed top 12 is flat and normal to the axis. The cap's skirt 10 is cylindrical and symmetrical about the vertical axis. The skirt 10 has the same outside diameter as the base B, so the entire side of the closure appears as one smooth cylinder. The top 12 and the top of post 7 are flush when the closure is closed. The closure has no outside projections or sharp parts, so the closure is safe for use by children. The new closure does not use loose seals, only the two integral parts being required. The seals are in effect, built-in the two parts of the closure.

All the cooperating plastic parts of the base and cap are smoothly finished and the cap turns on the base with little apparent frictional resistance. This may make it difficult to determine when the valve is fully closed.

Therefore at lease one of the threads 9 in its valley and just in advance of the end of the screw thread is formed with a rounded bump over which the approaching protuberances rides and then snaps against the end of the thread.

I claim:

1. A closure for a squeeze bottle having a neck, the closure comprising a base having a lower portion for connection to said neck and a tubular upper portion internally having an upstanding post mounted on a radial support fixed to the inside of the lower part, said support forming at least one axially extending passage, said base having an upstanding tubular extension having an external screw thread; and a cap having a skirt rotatively surrounding said upper portion, said skirt having at least one internal protuberance in screw-threaded engagement with said screw thread, said post having an upper end and said cap having a closed top in which a hole is formed in axial registration with said upper end and which is closed by said upper end when said cap is screwed downwardly and opened when said cap is screwed upwardly, said base having means for preventing complete unscrewing of said cap, said skirt being radially outwardly flexible so that said protuberance can be snapped into said screw-threaded engagement by pushing said cap onto said base to assembly said closure, said base integrally having an inwardly extending portion from which a frusto-conical elastic seal depends with an outward angularity and seals deflectingly against the top of said neck and, said closed top integrally having a depending elastic skirt seal and said tubular extension having an inside against which said skirt seal slidingly presses outwardly, said external screw thread having a terminal end against which said protuberance abuts to prevent said complete unscrewing; and said external screw thread having a bump in advance of said terminal end and having one side over which said protuberance elastically rides and having another side opposite to the first named side and which is engaged by the protuberance after it slides over the first named side at said terminal end.

* * * * *